US012624487B2

(12) United States Patent
Hu et al.

(10) Patent No.: US 12,624,487 B2
(45) Date of Patent: May 12, 2026

(54) WASHING MACHINE HOLD TIME ESTIMATION

(71) Applicant: Haier US Appliance Solutions, Inc., Wilmington, DE (US)

(72) Inventors: Haitian Hu, Louisville, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 127 days.

(21) Appl. No.: 18/364,892

(22) Filed: Aug. 3, 2023

(65) Prior Publication Data

US 2025/0043481 A1 Feb. 6, 2025

(51) Int. Cl.

| | |
|---|---|
| ***D06F 33/44*** | (2020.01) |
| *D06F 33/32* | (2020.01) |
| *D06F 101/14* | (2020.01) |
| *D06F 103/40* | (2020.01) |
| *D06F 105/50* | (2020.01) |
| *D06F 105/52* | (2020.01) |
| *D06F 105/58* | (2020.01) |

(52) U.S. Cl.

CPC ..... *D06F 33/44* (2020.02); *D06F 33/32* (2020.02); *D06F 2101/14* (2020.02); *D06F 2103/40* (2020.02); *D06F 2105/50* (2020.02); *D06F 2105/52* (2020.02); *D06F 2105/58* (2020.02)

(58) Field of Classification Search

CPC .. D06F 2105/50; D06F 33/44; D06F 2101/14; D06F 2103/40

See application file for complete search history.

(56) References Cited

U.S. PATENT DOCUMENTS

| | | | | |
|---|---|---|---|---|
| 8,984,692 | B2 * | 3/2015 | Balinski | D06F 33/43 8/149.1 |
| 2005/0000033 | A1 | 1/2005 | Park et al. | |
| 2008/0295696 | A1 * | 12/2008 | Kim | D06F 39/14 96/417 |
| 2012/0284930 | A1 * | 11/2012 | Robertson | D06F 35/00 68/12.02 |
| 2020/0024792 | A1 * | 1/2020 | Lee | H04L 12/2825 |

FOREIGN PATENT DOCUMENTS

| | | | | |
|---|---|---|---|---|
| CN | 106868793 B | | 5/2019 | |
| CN | 113463321 A | * | 10/2021 | D06F 33/32 |
| CN | 113512846 A | | 10/2021 | |
| CN | 114232276 A | | 3/2022 | |

OTHER PUBLICATIONS

Machine translation of CN-113463321-A, dated Oct. 1, 2021. (Year: 2021).*

* cited by examiner

*Primary Examiner* — Michael E Barr
*Assistant Examiner* — Kevin G Lee
(74) *Attorney, Agent, or Firm* — Dority & Manning, P.A.

(57) ABSTRACT

A method of operating a washing machine appliance includes receiving a start input for an operation of the washing machine appliance. The method also includes estimating a hold time that is predicted to occur after the operation. The method further includes determining the estimated hold time is greater than a maximum hold time. In response to the estimated hold time greater than the maximum hold time, an operation start time may be delayed or a keep fresh cycle may be performed after the operation.

17 Claims, 5 Drawing Sheets

WASHING MACHINE HOLD TIME ESTIMATION

FIELD OF THE INVENTION

The present subject matter relates generally to washing machine appliances.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

After the operation of the washing machine appliance is complete, the articles therein may be wet, e.g., damp, due to some remaining moisture content after the spin cycle. Accordingly, such articles are typically removed from the washing machine appliance for drying after the operation, such as line drying or drying in a dryer appliance. In some cases, however, the damp articles may remain in the washing machine appliance for an extended time period after completion of the wash operation, such as when a user may start the washing machine appliance and then go to bed or to work, or is otherwise unavailable to remove the damp articles promptly after the wash operation is completed. It may be undesirable for the damp articles remain enclosed within the washing machine appliance for such an extended time period, such as odors may develop or mildew may form.

As a result, it is desired in the art to provide improved washing machine appliances and related methods, such as which may provide information regarding a predicted holding time in the washing machine appliance and/or may include functions for preventing or reducing the undesirable effects of an extended holding time for damp articles in the washing machine appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The method includes receiving a start input for an operation of the washing machine appliance. The method also includes estimating a hold time that is predicted to occur after the operation. The method further includes determining the estimated hold time is greater than a maximum hold time. In response to the estimated hold time greater than the maximum hold time, an operation start time is delayed.

In another exemplary aspect of the present disclosure, a method of operating a washing machine appliance is provided. The method includes receiving a start input for an operation of the washing machine appliance. The method also includes estimating a hold time that is predicted to occur after the operation. The method further includes determining the estimated hold time is greater than a maximum hold time. The method also includes performing a keep fresh cycle after the operation in response to the estimated hold time greater than the maximum hold time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
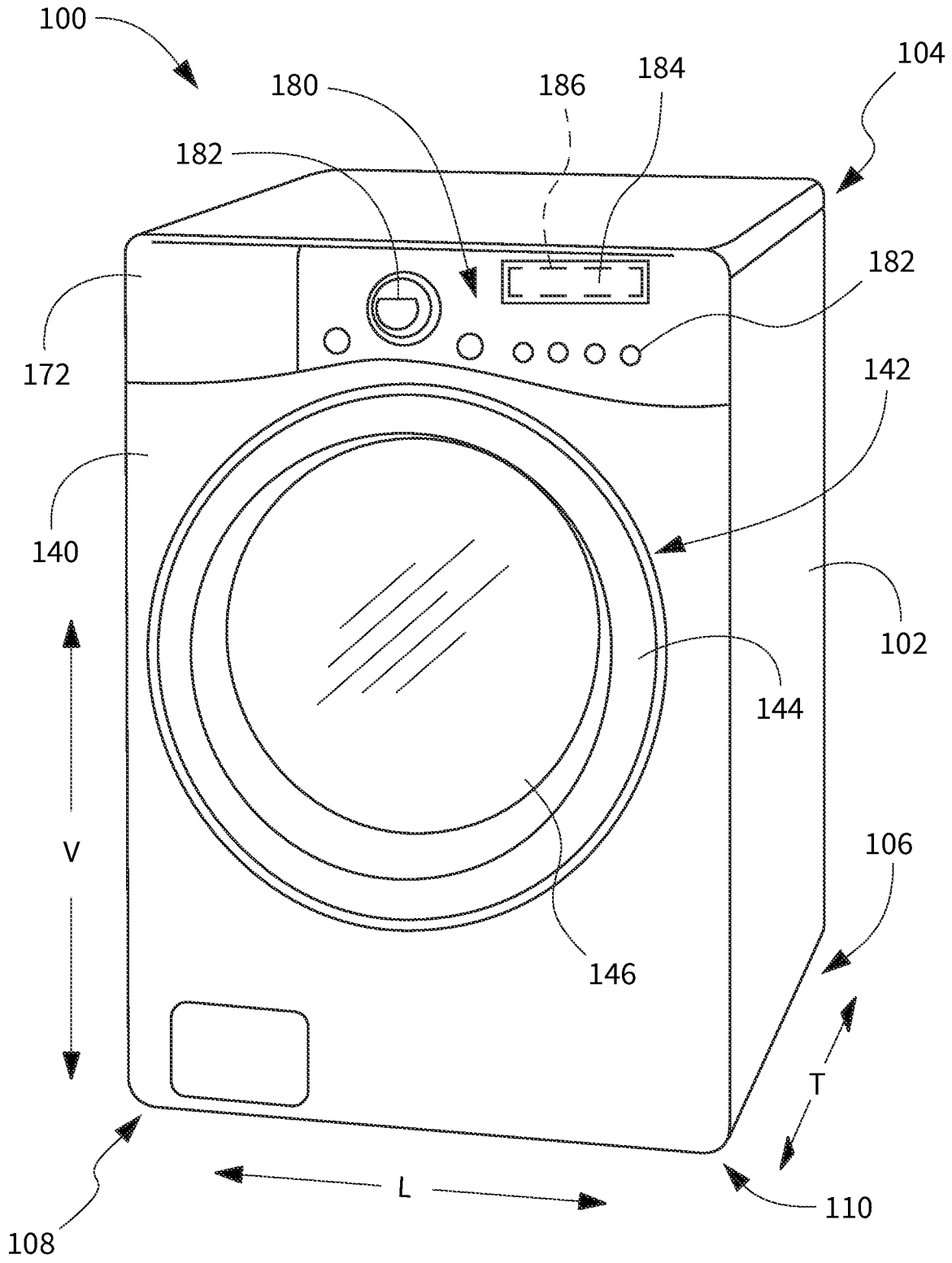
FIG. 1 provides a perspective view of a washing machine appliance according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Terms such as "inner" and "outer" refer to relative directions with respect to the interior and exterior of the washing machine appliance, and in particular the wash basket therein. For example, "inner" or "inward" refers to the direction towards the interior of the washing machine appliance. Terms such as "left," "right," "front," "back," "top," or "bottom" are used with reference to the perspective of a user accessing the washing machine appliance. For example, a user stands in front of the washing machine appliance to open the door and reaches into the wash basket to access items therein. Furthermore, it should be appreciated that as used herein, terms of approximation, such as "approximately," "substantially," or "about," refer to being within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise.

Figure 2:
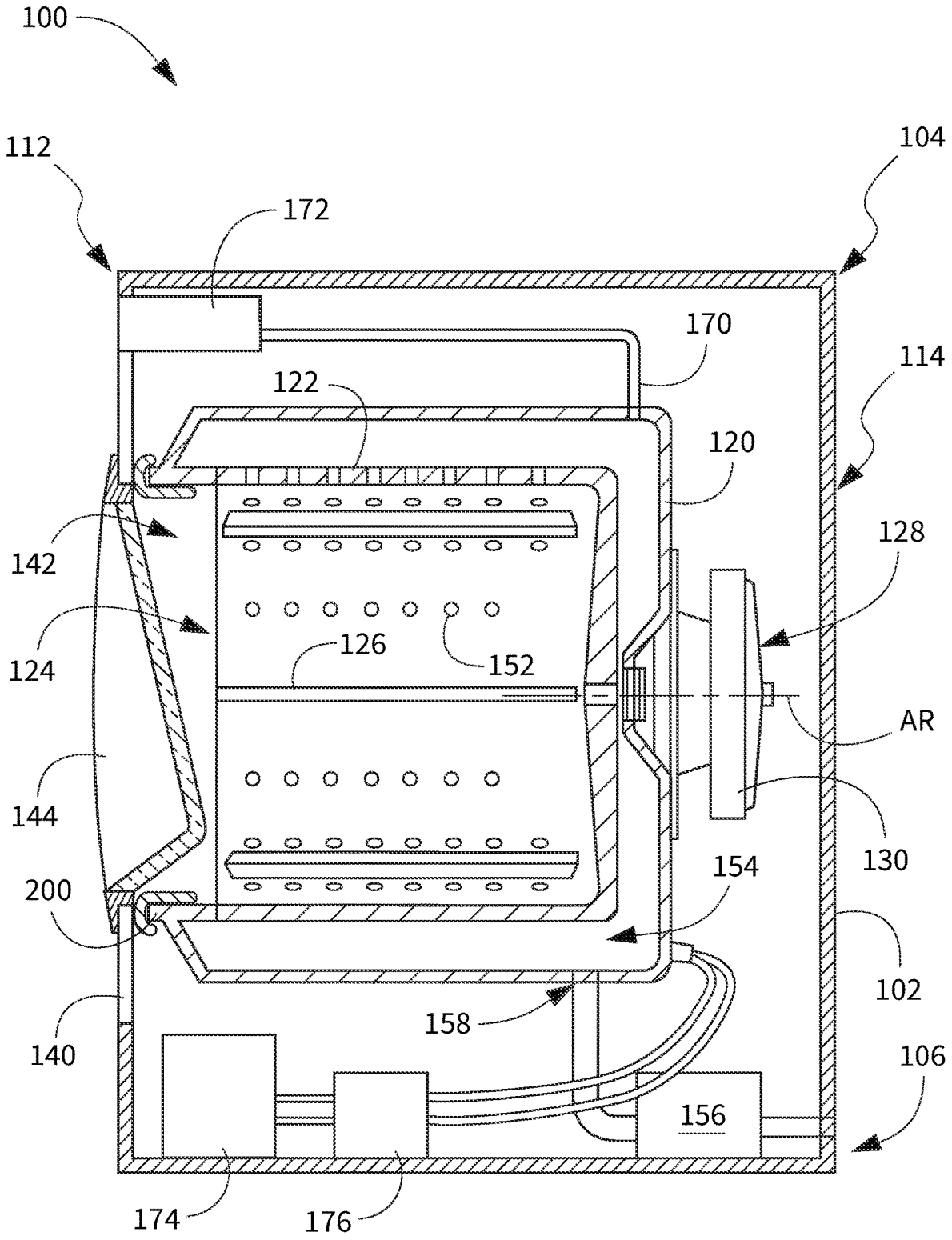
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L. and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation AR. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIG. 2, drive assembly 128 may include a motor assembly 130 that is in mechanical communication with wash basket 122 to selectively rotate wash basket 122 (e.g., during an agitation or a rinse cycle of washing machine appliance 100). According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122. More specifically, washing machine appliance 100 includes a door 144 that is positioned over opening 142 and is rotatably, e.g., pivotably, mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120. For example, when the door 144 is in the closed position, the wash tub 120 may be generally enclosed (e.g., at least 90% enclosed and at least 90% surrounded on all sides, such as fully enclosed with the exception of a vent line 190 and/or vent aperture 202 as will be described below) by the door 144 and the cabinet 102. A gasket 200 may be provided in the opening 142 and the gasket 200 may sealingly engage the door 144 when the door 144 is in the closed position. For example, the gasket 200 may extend between the tub 120 and the front panel 140, e.g., generally along the transverse direction T and may extend about or around the opening 142 such that the gasket 200 is covered by the door 144 when the door 144 is in the closed position, and the gasket 200 may promote sealing between the door 144 and the cabinet 102, e.g., the front panel 140 of the cabinet 102.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through the plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120. Accordingly, pump assembly 156 may also be referred to or include a drain pump and/or a circulation pump.

Referring still to FIGS. 1 and 2, in some embodiments, washing machine appliance 100 may include an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In some embodiments, an optional bulk reservoir 174 may be disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 may be configured for selective delivery of the fluid additive from bulk reservoir 174 to wash tub 120.

A control panel 180 including a plurality of input selectors 182 may be coupled to front panel 140. Control panel 180 and input selectors 182 collectively form a user interface input for operator selection of machine cycles and features. A display 184 of control panel 180 indicates selected features, operation mode, a countdown timer, and/or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 may be in communication with controller 186 via one or more signal lines or shared communication busses to provide signals to and/or receive signals from the controller 186.

In addition, the memory or memory devices of the controller 186 can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 186 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 186 as disclosed herein is capable of and may be operable to perform any methods, method steps, or portions of methods as disclosed herein. For example, in some embodiments, methods disclosed herein may be embodied in programming instructions stored in the memory and executed by controller 186.

The memory devices may also store data that can be retrieved, manipulated, created, or stored by the one or more processors or portions of controller 186. The data can include, for instance, data to facilitate performance of methods described herein. The data can be stored locally (e.g., on controller 186) in one or more databases and/or may be split up so that the data is stored in multiple locations. In addition, or alternatively, the one or more database(s) can be connected to controller 186 through any suitable network(s), such as through a high bandwidth local area network (LAN) or wide area network (WAN). In this regard, for example, controller 186 may further include a communication module or interface that may be used to communicate with one or more other component(s) of washing machine appliance 100, controller 186, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation AR at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

During such operations, the gasket 200 may help to contain wash fluid within the cabinet 102, particularly within the tub 120. As generally shown in FIG. 2, the gasket 200 may be positioned between the door 144 and the tub 120, e.g., when the door 144 is in the closed position as in FIG. 2. Thus, the gasket 200 may sealingly engage the door 144 when the door 144 is in the closed position. In general, the gasket 200 sealingly engages the cabinet 102, in particular the opening 142 thereof, the tub 120, and the door 144. For example, the gasket 200 may extend around the opening 142 along a perimeter, e.g., circumference, of the opening 142 and may extend between the cabinet 102 and the wash tub 120 along a longitudinal axis, such as along or generally parallel to the transverse direction T.

It should be appreciated that the present subject matter is not limited to any particular style, model, or configuration of washing machine appliance. The exemplary embodiment depicted in FIGS. 1 and 2 is simply provided for illustrative purposes only. While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well. For example, different locations may be provided for the user interface, different configurations may be provided, e.g., vertical axis washing machines, and other differences may be applied as well.

Figure 3:
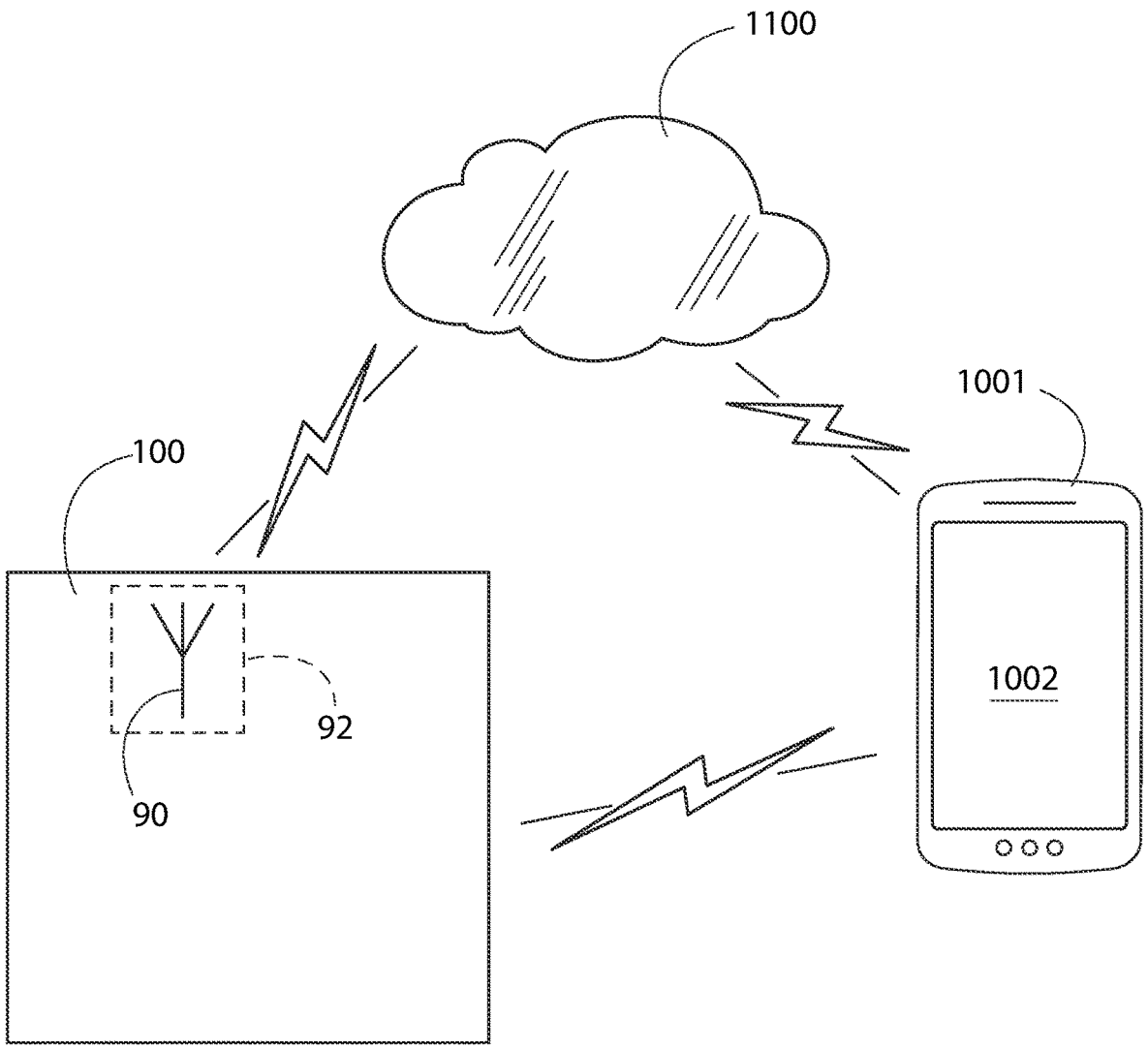
FIG. 3 provides a diagrammatic illustration of a washing machine appliance in communication with a remote computing device and with a remote user interface device according to one or more exemplary embodiments of the present subject matter.

A general schematic of a washing machine appliance 100, such as but not limited to washing machine appliance 100 described above, which communicates wirelessly with a remote user interface device 1001 and a network 1100 is provided in FIG. 3. For example, as illustrated in FIG. 3, the washing machine appliance 100 may include an antenna 90 by which the washing machine appliance 100 communicates with, e.g., sends and receives signals to and from, the remote user interface device 1001 and/or network 1100. The antenna 90 may be part of, e.g., onboard, a communications module 92. The communications module 92 may be a wireless communications module operable to connect wirelessly, e.g., over the air, to one or more other devices via any suitable wireless communication protocol. For example, the communications module 92 may be a WI-FI® module, a BLUETOOTH® module, or a combination module providing both WI-FI® and BLUETOOTH® connectivity. The remote user interface device 1001 may be a laptop computer, smartphone, tablet, personal computer, wearable device, smart speaker, smart home system, and/or various other suitable devices. The communications module 92 may be onboard the controller 186 or may be a separate module.

The washing machine appliance 100 may be in communication with the remote user interface device 1001 device through various possible communication connections and interfaces. The washing machine appliance 100 and the remote user interface device 1001 may be matched in wireless communication, e.g., connected to the same wireless network. The washing machine appliance 100 may communicate with the remote user interface device 1001 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the washing machine appliance 100 and the remote user interface device 1001. For example, BLUETOOTH® Low Energy may advantageously minimize the power consumed by the exemplary methods and devices described herein due to the low power networking protocol of BLUETOOTH® Low Energy.

The remote user interface device 1001 is "remote" at least in that it is spaced apart from and not structurally connected to the washing machine appliance 100, e.g., the remote user interface device 1001 is a separate, stand-alone device from the washing machine appliance 100 which communicates with the washing machine appliance 100 wirelessly. Any suitable device separate from the washing machine appliance 100 that is configured to provide and/or receive communications, information, data, or commands from a user may serve as the remote user interface device 1001, such as a smartphone (e.g., as illustrated in FIG. 3), smart watch, personal computer, smart home system, or other similar device. For example, the remote user interface device 1001 may be a smartphone operable to store and run applications, also known as "apps," and some or all of the method steps disclosed herein may be performed by a smartphone app.

The remote user interface device 1001 may include a memory for storing and retrieving programming instructions. Thus, the remote user interface device 1001 may provide a remote user interface which may be an additional user interface to the user interface panel 180. For example, the remote user interface device 1001 may be a smartphone operable to store and run applications, also known as "apps," and the additional user interface may be provided as a smartphone app.

As mentioned above, the washing machine appliance 100 may also be configured to communicate wirelessly with a network 1100. The network 1100 may be, e.g., a cloud-based data storage system including one or more remote computing devices such as remote databases and/or remote servers, which may be collectively referred to as "the cloud." The network 1100 may include, e.g., one or more remote computing devices, such as a remote database, remote server, etc., in a distributed computing environment. Such distributed computing environments may include, for example, cloud computing, fog computing, and/or edge computing. For example, the washing machine appliance 100 may communicate with the network 1100 over the Internet, which the washing machine appliance 100 may access via WI-FI®, such as from a WI-FI® access point in a user's home, or in a laundromat or dormitory, etc.

The remote user interface device 1001 may be configured to capture and/lor display images. For example, the remote user interface device 1001 may be a smartphone, e.g., as illustrated in FIG. 3, which includes both a camera (not shown) for capturing images and a display 1002, e.g., a touchscreen or other screen, for displaying images.

As noted above, controller 186 is capable of and may be operable to perform any methods, method steps, or portions of methods as disclosed herein. Additionally, such methods, methods steps or portions of methods may be performed locally (e.g., on controller 186) or remotely, e.g., by a remote computing device (e.g., in the "edge," the "fog," and/or in the "cloud," as those of ordinary skill in the art will recognize as referring to a remote computing device, such as a server, database, or the like, in a distributed computing environment including at least one remote computing device in communication with the local controller 186, such as the exemplary network 1100 illustrated in FIG. 3 and described above). Also by way of example, such performance may be mixed, such as partially local and partially remote.

Embodiments of the present disclosure may include systems, such as systems for observing usage of a washing machine appliance and predicting or estimating future usage of the washing machine appliance. Such systems may also be used for implementing remedial or preventive actions in response to or based on such estimates in order to avoid or ameliorate effects of the predicted usage. For example, such systems may include the washing machine appliance, e.g., as described above, and one or more remote computing devices, e.g., also as described above in the context of FIG. 3.

Such systems may be configured for observing usage of the washing machine appliance, such as recording and averaging or otherwise analyzing hold times in the washing machine appliance which occur after operations of the washing machine appliance. For example, such operation of the washing machine appliance may be a washing operation in which articles in the washing machine appliance are wetted with water or other wash fluids, as described above. The hold time may occur after such washing operation, and may be the time duration over which the wet articles remain enclosed within the washing machine appliance, such as the time duration from the end of the washing operation until the door of the washing machine appliance is opened. The opening of the door may be detected by one or more sensors or other devices in the washing machine appliance, such as a door switch, an audio detector, e.g., microphone, that detects the sound of the door opening, and/or inertial sensors such as an accelerometer. Thus, a hold time may be determined following each operation of the washing machine appliance, and each hold time may be stored in a washing machine appliance usage history, such as in a remote database, e.g., in the cloud.

The hold times stored in the usage history may be averaged, and an average hold time from the usage history may be used to predict or estimate the hold time to occur after a selected cycle, e.g., in response to a cycle selection input and a start input. For example, the average hold time may be based on hold times that occurred following operations which started around the same time or at a similar time, such as the same time of day or day of the week, as the currently selected cycle, e.g., at a time similar to the time when the start input is received. In some embodiments, a remote computing device may be used to run a washing machine appliance operation observer software, and the washing machine appliance operation observer software may access the usage history to calculate the average hold times.

The hold times from previous operations, such as the average hold time that occurred after similar previous operations, where similar previous operations may be or include operations that started at a similar time as the time when the start input is received, may be used to predict or estimate the hold time that may occur after the upcoming, currently selected cycle. Such estimated hold time may be compared to a maximum hold time. The maximum hold time may be a predetermined hold time, such as a predetermined default hold time or a hold time that is predetermined from a user input provided prior to the current cycle, e.g., the maximum hold time may be defined by a user, such as defined based on a user input received via an app on a smartphone or other remote user interface device 1001.

When the estimated hold time is greater than the maximum hold time, the system may used for implementing remedial or preventive actions, such as delaying the start of the operation to reduce the hold time, e.g., such that wet articles are not enclosed within the washing machine appliance after the operation for too long. The system may also or instead perform a keep fresh cycle after the operation in response to the estimated hold time greater than the maximum hold time. For example, when it is determined, e.g., by the remote computing device(s), that the estimated hold time is greater than the maximum hold time, the remote computing device(s) may transmit a command to the washing machine appliance and such command may cause the washing machine appliance to append the keep fresh cycle to the currently selected operation. The keep fresh cycle may include, for example, periodic refreshing operations such as tumbling clothes at a low speed, turning on an exhaust fan, and/or turning on a heater, in embodiments where an exhaust fan and/or heater is provided or are provided in the washing machine appliance. The frequency of periodic refreshing operations may be determined by a user customized hold time, e.g., a user customized time limit of wet clothes in washer. Delaying the start of the operation may include using an operation start time suggestion creator engine, e.g., software or software module, to determine an offset, e.g., delay, for the start of the operation that will reduce the hold time to less than the maximum hold time. The operation start time suggestion creator may calculate the start time based on one or more of the start time of the currently selected cycle, updated average time (e.g., hours) between the end of an operation and the first door opening, settings of the currently selected cycle, and/or the maximum hold time. As with any and all other software, algorithms, and other processes described herein, the operation start time suggestion creator may be implemented remotely, e.g., in the cloud, etc., or locally, e.g., by the controller 186 of the washing machine appliance.

The output of the operation start time suggestion creator may be implemented automatically or may be provided to a user, e.g., in a message on a remote user interface device and/or on a display of the washing machine appliance, for manual implementation. In embodiments where the output is implemented automatically, a user notification may be provided (on a remote user interface device and/or display of the washing machine appliance), and such notification may permit the user to override the delayed start time, e.g., by pressing a prompt on a touchscreen or a button on one or both of the remote user interface device or control panel 180. In such embodiments, the operation start time may be delayed unless a user input is received. In embodiments where the output is provided to the user, the output may be provided as a suggested delay, with possible responses of accepting the suggestion, rejecting the suggestion, or modifying the suggestion, e.g., delaying the start of the operation for more or less time than suggested. Thus, in such embodiments, the operation start time may be delayed in response to a user input, such as when the user input includes accepting the suggested delay or modifying the suggestion to delay the operation start for a different amount of time (greater than zero).

Exemplary systems and methods according to the present disclosure may include learning, e.g., may be continually updated with additional data. For example, the usage history may be continually updated every time an operation of the washing machine appliance is performed. Such updates may allow refinement in the estimation of hold times, such as the similar start time may initially be within the same hour, and then narrowed as the usage history increases, such as to thirty minute or fifteen minute blocks of time from hourly. As another example, such systems and methods may be updated in response to user feedback. Such user feedback may include modified suggested delays and/or rejections of suggested delays.

Embodiments of the present disclosure include methods of operating a washing machine appliance. Such methods may include receiving an operation selection or cycle selection, and receiving a start input to initiate the selected operation. The time from completion of the operation to unloading of articles from the washing machine appliance may be estimated. Such methods may proceed to a decision function of comparing the estimated time to a time limit. When the estimated time is less than or equal to the time limit, the new wash operation may be started. When the estimated time is greater than the time limit, a suggested operation start time may be created and sent to a user. Such methods may then proceed to another decision function of determining whether the user accepted the suggestion. When it is determined that the user accepted the suggestion, such methods may then delay the operation, and may perform a keep fresh cycle after the operation. When it is determined that the user rejected the suggestion, such methods may start the operation, and may perform the keep fresh cycle after the operation. Such methods may further include adding data from the operation to a usage history, e.g., in the cloud or locally stored usage history.

Figure 4:
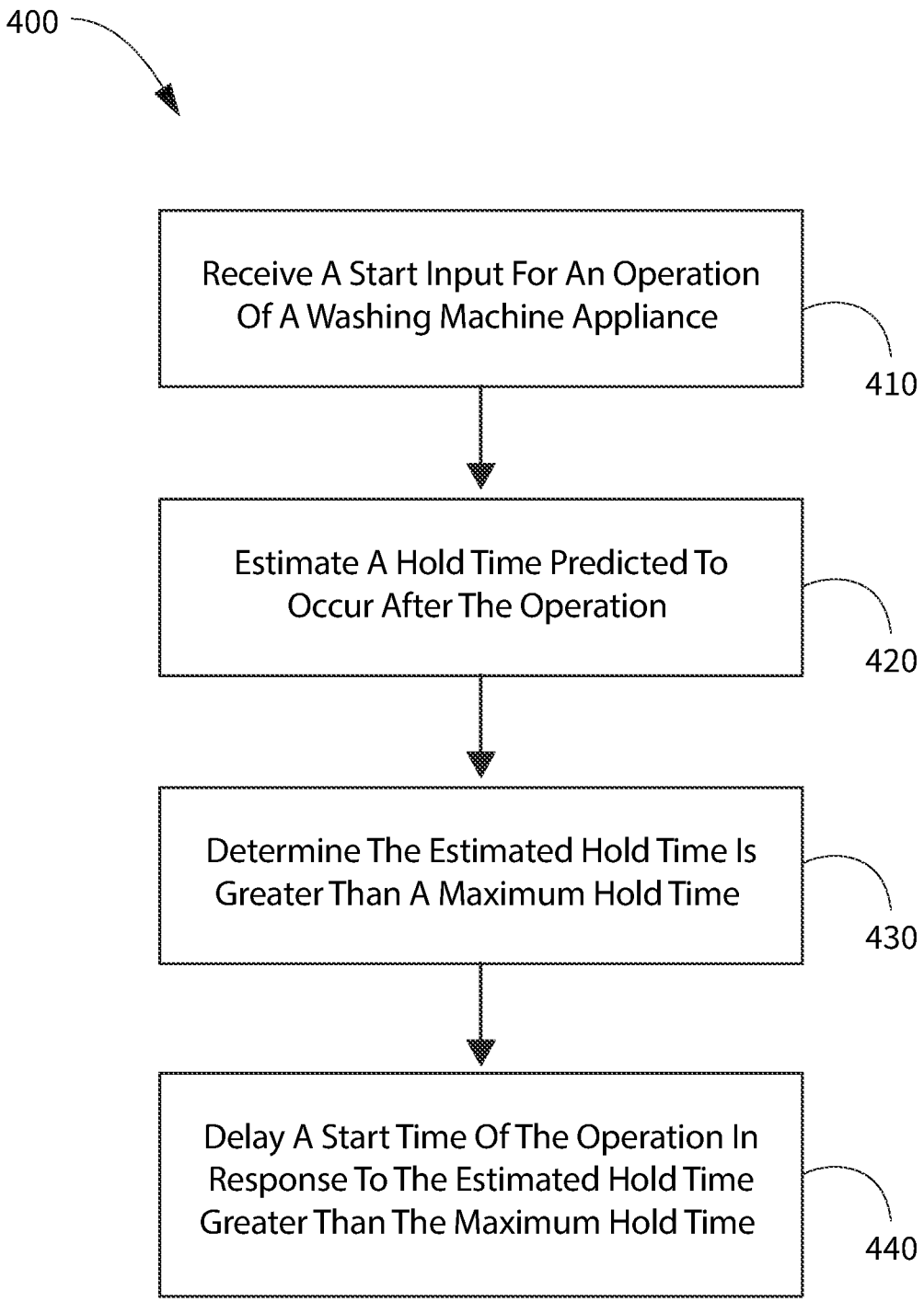
FIG. 4 provides a flow diagram of an exemplary method of operating a washing machine appliance according to one or more exemplary embodiments of the present disclosure.
Figure 5:
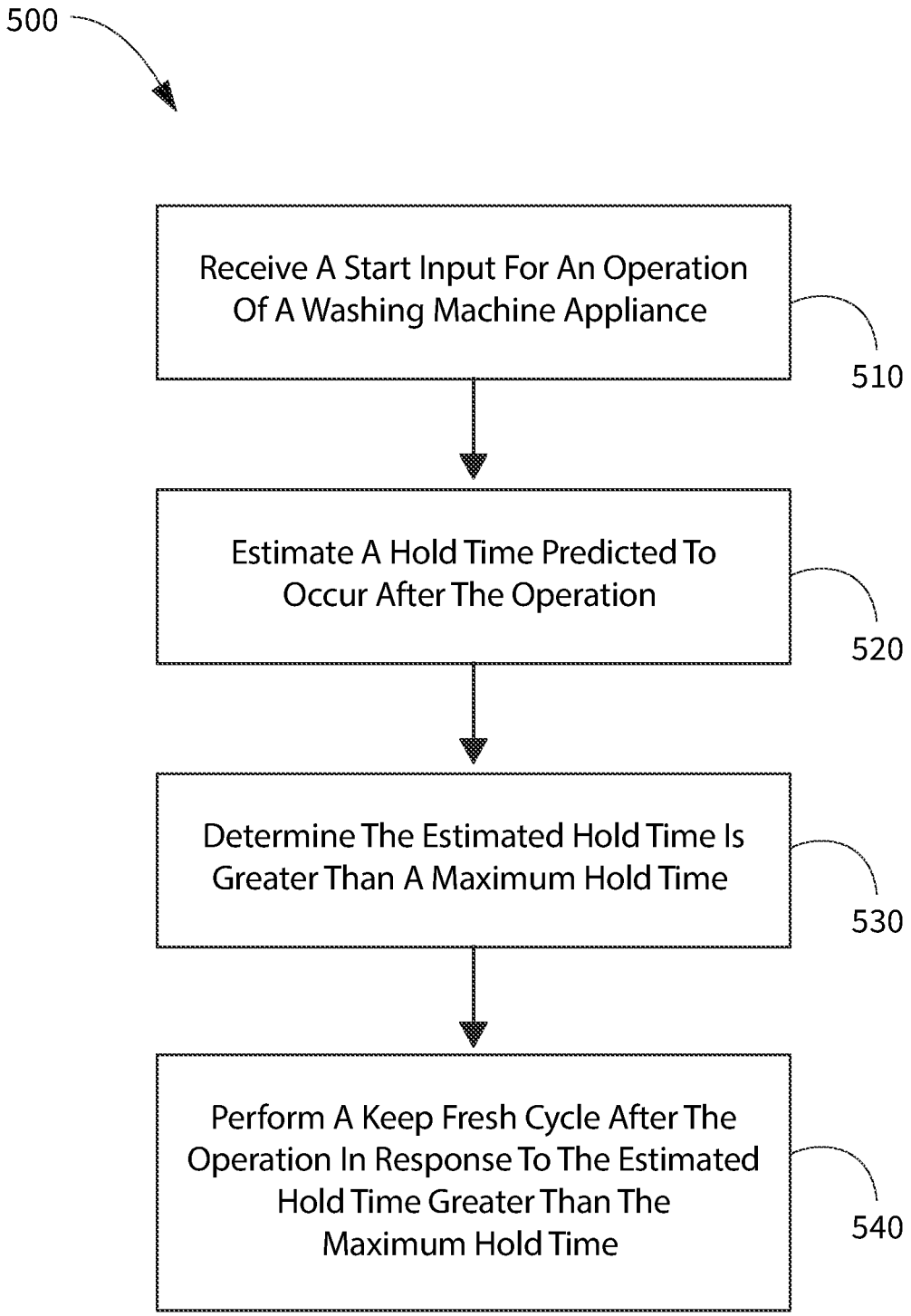
FIG. 5 provides a flow diagram of another exemplary method of operating a washing machine appliance according to one or more additional exemplary embodiments of the present disclosure.

Additional exemplary methods of operating a washing machine appliance according to one or more exemplary embodiments of the present disclosure include the exemplary method 400 illustrated in FIG. 4 and the exemplary method 500 illustrated in FIG. 5. Method 400 and/or 500 may be implemented using any suitable appliance, including for example, washing machine appliance 100 of FIGS. 1 and 2. Accordingly, to provide context to methods 400 and 500, reference numerals utilized to describe the features of washing machine appliance 100 in FIGS. 1 and 2 may be used below.

Methods 400 and 500 may include receiving a start input for an operation of the washing machine appliance, e.g., as indicated at 410 in FIG. 4 and at 510 in FIG. 5. Methods 400 and 500 may also include estimating a hold time, e.g., as indicated at 420 in FIGS. 4 and 520 in FIG. 5. The hold time may be predicted to occur after the operation, such as the hold time may be an amount of time that the door of the washing machine appliance may remain closed after the operation is completed.

Exemplary methods of operating a washing machine appliance according to the present disclosure, such as method 400 and/or method 500, may further include comparing the estimated hold time to a maximum hold time. For example, such methods may include determining the estimated hold time is greater than a maximum hold time, e.g., as indicated at 430 in FIGS. 4 and 530 in FIG. 5. Such methods may also include one or more remedial or preventative measures.

For example, referring now to FIG. 4 specifically, some embodiments may include delaying a start time of the operation in response to the estimated hold time greater than the maximum hold time, e.g., as indicated at 440. As another example, with reference to FIG. 5 in particular, some embodiments may include performing a keep fresh cycle after the operation in response to the estimated hold time greater than the maximum hold time, e.g., as indicated at 540. Referring now generally to FIGS. 4 and 5, the methods 400 and 500 may be interrelated and/or may have one or more steps from one of the methods 400 and 500 combined with the other method 400 or 500. Thus, those of ordinary skill in the art will recognize that the various steps of the exemplary methods described herein may be combined in various ways to arrive at additional embodiments within the scope of the present disclosure. For example, method 400 may also include the keep fresh cycle, and method 500 may also include a delayed start time.

In some embodiments, exemplary methods according to the present disclosure may include determining a time dimension when the start input is received, and the estimated hold time may be based on the time dimension. The estimated hold time may be based on the time dimension in that the estimated hold time may be determined by looking at hold times from past operations of the washing machine appliance which had the same or similar (e.g., approximately the same) time dimension. For example, the estimated hold time may be an average hold time of the past operations having the same or similar time dimension. In various embodiments, the estimated time may be based on one or more time dimensions, and such time dimensions may include the day of the week, such as weekday versus weekend, the time of day, e.g., where a washing machine operation having a later start time is more likely to have long hold time, days of the year, such as holiday, and/or a custom time dimension, such as birthdays, vacation times, or times when a babysitter is at home instead of parents, among other possible custom time dimensions. Additional time dimensions may be used as well as or instead of the previous examples, such as seasons or other time dimensions.

In some embodiments where the estimated time is estimated locally and/or the usage history is stored locally, fewer time dimensions may be used as compared to embodiments where the estimating and/or usage history storage are remote, such as to preserve limited computing resources onboard the washing machine appliance. For example, in some embodiments only one time dimension, e.g., time of day, may be used to estimate the hold time, such as when the usage history is locally stored. In some embodiments, when the washing machine appliance is connected to one or more remote computing devices and then becomes disconnected, the washing machine appliance may use the last data received from the one or more remote computing devices while disconnected, and may locally store data, e.g., user feedback and/or hold times, while disconnected. When the washing machine appliance is reconnected, the washing machine appliance may, in such embodiments, then upload the locally stored data to the one or more remote computing devices, e.g., in order to update the washing machine operation observer and/or cycle time suggestion creator. In some embodiments, the washing machine appliance 100 may remain connected to the remote user interface device 1001 even when not connected to other networks. For example, the washing machine appliance 100 may communicate with the remote user interface device 1001 directly (e.g., independent of any other connection), such as via BLUETOOTH, as described above, or Near-Field Communication ("NFC"). Accordingly, the remote user interface device 1001 may be used to provide a supplemental and/or expanded user interface for the washing machine appliance 100 regardless of internet connectivity.

In embodiments where the time dimension is or includes time of day, the time of day may be measured in various increments. For example, the time of day may be measured in hourly blocks, e.g., from 9:00 to 9:59 may be a 9 o'clock time dimension, from 10:00 to 10:59 may be a 10 o'clock time dimension, etc. In additional embodiments, the time of day may be measured in larger increments, such as two-hour blocks or three-hour blocks, or larger. In further additional embodiments, the time of day may be measured in smaller increments, such as about thirty minutes or less, such as about fifteen minutes or less, such as about ten minutes or less.

In some embodiments, the estimated hold time may be based on a usage history. For example, the estimated hold time may be based on one or more hold times which occurred after previous operations of the washing machine appliance. In some embodiments, the hold time may be estimated based on the entire usage history. In additional embodiments, the hold time may be estimated based on only selected portions of the usage history, such as hold times which occurred after previous operations that are similar to the currently selected operation, e.g., have a same or similar time dimension and/or same or similar operating parameters.

As mentioned above, the estimated hold time may be compared to a maximum hold time, e.g., some exemplary methods according to the present disclosure may include determining the estimated hold time is greater than the maximum hold time. The maximum hold time may be a default value, such as about two hours. The maximum hold time may be a user-defined maximum hold time. The user-defined maximum hold time may be limited to no more than twelve hours, e.g., the user may have the option to choose any user-defined maximum hold time that is shorter than twelve hours. For example, the user-defined maximum hold time may be received via a user input from the control panel 180 or a remote user interface device 1001.

When the estimated hold time is greater than the maximum hold time, exemplary methods according to the present disclosure may include creating a suggested operation start time. As mentioned above, the suggested operation start time may be implemented automatically or may be implemented after the user accepts the suggestions. For example, some embodiments may include providing a user notification with the suggested operation start time. In embodiments where the suggested operation start time is implemented automatically, the user notification may be informative only, or may be configured to accept an override input, wherein the operation will be delayed, e.g., started at the suggested operation start time, unless the override input is received. In embodiments where the suggested operation start time is manually implemented, the operation may be delayed after the suggested operation start time is accepted, e.g., in such embodiments, delaying the operation start time may include starting the operation of the washing machine appliance at the suggested operation start time in response to an affirmative response to the user notification. Additionally, and also as described above, the operation may be delayed by a custom amount or user-defined delay. For example, some embodiments may include receiving user feedback, e.g., via the control panel 180 or remote user interface device 1001, in response to the user notification. The user feedback may include a user-specified operation start time or user-specified delay time amount. In such embodiments, delaying the operation start time may include starting the operation of the washing machine appliance at the user-specified operation start time or after the user-specified delay time amount. Such embodiments may further include updating a cycle start time suggestion creator, e.g., based on the user-specified operation start time.

As noted above, the present disclosure may also include learning features, e.g., updating one or more models using new data as additional operations of the washing machine appliance are performed. For example, in some embodiments, exemplary methods of operating a washing machine appliance according to the present disclosure may include detecting a door opening after completing the operation, determining a time between receiving the start input and detecting the door opening, and updating the usage history based on the determined time between receiving the start input and detecting the door opening.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the method comprising:

observing usage of the washing machine appliance, wherein observing usage of the washing machine appliance comprises:

performing a plurality of operations of the washing machine appliance, recording a plurality of hold times, each hold time occurring after one respective operation of the plurality of operations of the washing machine appliance, each hold time defined by a time duration from the end of the respective operation until a door of the washing machine appliance is opened, and calculating an average hold time based on the plurality of recorded hold times;

receiving a start input for an operation of the washing machine appliance;

estimating a hold time based on the calculated average hold time, the estimated hold time predicted to occur after the operation;

determining the estimated hold time is greater than a maximum hold time; and delaying a start time of the operation in response to the estimated hold time greater than the maximum hold time.

2. The method of claim 1, further comprising determining a time dimension when the start input is received, wherein the estimated hold time is based on the time dimension.

3. The method of claim 1, further comprising detecting a door opening after completing the operation, determining a time between receiving the start input and detecting the door opening, and updating the average hold time based on the determined time between receiving the start input and detecting the door opening.

4. The method of claim 1, further comprising creating a suggested operation start time, and providing a user notification with the suggested operation start time.

5. The method of claim 4, wherein delaying the operation start time comprises starting the operation of the washing machine appliance at the suggested operation start time in response to an affirmative response to the user notification.

6. The method of claim 4, further comprising receiving user feedback, the user feedback comprising a user-specified operation start time, wherein delaying the operation start time comprises starting the operation of the washing machine appliance at the user-specified operation start time, further comprising updating a cycle start time suggestion creator based on the user-specified operation start time.

7. The method of claim 1, further comprising performing a keep fresh cycle after the operation in response to the estimated hold time greater than the maximum hold time.

8. The method of claim 1, wherein the maximum hold time is a user-defined maximum hold time.

9. A method of operating a washing machine appliance, the method comprising:

observing usage of the washing machine appliance, wherein observing usage of the washing machine appliance comprises:

performing a plurality of operations of the washing machine appliance, recording a plurality of hold times, each hold time occurring after one respective operation of the plurality of operations of the washing machine appliance, each hold time defined by a time duration from the end of the respective operation until a door of the washing machine appliance is opened, and calculating an average hold time based on the plurality of recorded hold times;

receiving a start input for an operation of the washing machine appliance;

estimating a hold time based on the calculated average hold time, the estimated hold time predicted to occur after the operation;

determining the estimated hold time is greater than a predetermined maximum hold time; and performing a keep fresh cycle after the operation in response to the estimated hold time greater than the maximum hold time.

10. The method of claim 9, further comprising delaying an operation start time in response to the estimated hold time greater than the maximum hold time.

11. The method of claim 9, further comprising determining a time dimension when the start input is received, wherein the estimated hold time is based on the time dimension.

12. The method of claim 9, further comprising detecting a door opening after completing the operation, determining a time between receiving the start input and detecting the door opening, and updating the average hold time based on the determined time between receiving the start input and detecting the door opening.

13. The method of claim 9, further comprising creating a suggested operation start time, and providing a user notification with the suggested operation start time.

14. The method of claim 13, wherein delaying the operation start time comprises starting the operation of the washing machine appliance at the suggested operation start time in response to an affirmative response to the user notification.

15. The method of claim 13, further comprising receiving user feedback, the user feedback comprising a user-specified operation start time, wherein delaying the operation start time comprises starting the operation of the washing machine appliance at the user-specified operation start time, further comprising updating a cycle start time suggestion creator based on the user-specified operation start time.

16. The method of claim 9, wherein the maximum hold time is a user-defined maximum hold time.

17. A method of operating a washing machine appliance, the method comprising:

receiving a start input for an operation of the washing machine appliance;

estimating a hold time, the hold time predicted to occur after the operation;

determining the estimated hold time is greater than a maximum hold time;

delaying a start time of the operation in response to the estimated hold time greater than the maximum hold time;

receiving user feedback, the user feedback comprising a user-specified operation start time, wherein delaying the operation start time comprises starting the operation of the washing machine appliance at the user-specified operation start time; and updating a cycle start time suggestion creator based on the user-specified operation start time.

* * * * *